US006164669A

United States Patent [19]

Svensson

[11] Patent Number: 6,164,669

[45] **Date of Patent: *Dec. 26, 2000**

[54] IN-LINE SKATE BASE WITH REPLACEABLE WEAR PADS

[75] Inventor: John E. Svensson, Vashon, Wash.

[73] Assignee: K-2 Corporation, Vashon, Wash.

[ * ] Notice: This patent issued on a continued prosecution application filed under 37 CFR 1.53(d), and is subject to the twenty year patent term provisions of 35 U.S.C. 154(a)(2).

[21] Appl. No.: 08/879,432

[22] Filed: Jun. 20, 1997

[51] Int. Cl.[7] ..... A63C 17/00

[52] U.S. Cl. ..... 280/11.3; 280/11.221; 280/11.224

[58] Field of Search ..... 280/11.21, 11.19, 280/11.22, 11.2, 11.3, 7.13, 7.12, 7.14, 811, 809; 36/115

[56] References Cited

U.S. PATENT DOCUMENTS

| | | | |
|---|---|---|---|
| 1,826,616 | 10/1931 | Johnson | 280/811 |
| 4,214,768 | 7/1980 | Dominy et al. | 280/809 |
| 5,234,230 | 8/1993 | Crane et al. | 280/811 |
| 5,340,132 | 8/1994 | Malewicz | 280/11.22 |
| 5,630,624 | 5/1997 | Goodman | 280/809 |
| 5,806,860 | 9/1998 | Conte | 280/11.22 |
| 5,836,591 | 11/1998 | Roderick et al. | 280/11.22 |

FOREIGN PATENT DOCUMENTS

| | | |
|---|---|---|
| 2 754 463 | 4/1998 | France . |
| 295 12 532 U1 | 11/1995 | Germany . |
| WO 98/00206 | 1/1998 | WIPO . |

OTHER PUBLICATIONS

*Box*, Issue 9 Mid Coast advertisement (p. 54), PORTfolio advertisement (p55), Commit Enterprises Inc. advertisement (p. 76), summer 1996.

*Primary Examiner*—Daniel G. DePumpo
*Assistant Examiner*—James S. McClellan
*Attorney, Agent, or Firm*—Christensen O'Connor Johnson Kindness PLLC

[57] ABSTRACT

An in-line skate (10) has an upper shoe portion (40) for receiving a person's foot that is secured to an upper surface of an upper base (56). A lower base (14) has an upper surface (64) that is detachably secured by fasteners (72) to the lower surface (60) of the upper base. A frame (16) for mounting a plurality of wheels (20) is secured to the lower surface of the lower base. The lower base defines a plurality of grind apertures (82) laterally and medially adjacent either side of the frame. A plurality of wear pads (32, 36, 38) are received on the upper surface of the lower base, and include wear portions that project downwardly through the apertures below the lower surface of the lower base. A flange defined on each of the wear pads is captured between the lower base and the upper base when the bases are assembled together. An additional wear pad (34) is secured to the exterior of the base by a tongue and groove engagement. The wear pads provide wear-resistant, low friction surfaces on the underside of the base on which a skater may slide or "grind" along elongate surfaces such as curbs, ramps, and rails. The wear pads may be replaced when worn to prolong the life of the skate.

37 Claims, 3 Drawing Sheets

IN-LINE SKATE BASE WITH REPLACEABLE WEAR PADS

FIELD OF THE INVENTION

The present invention relates to roller skates, and more particularly to in-line roller skates for use in aggressive skating.

BACKGROUND OF THE INVENTION

The sport of aggressive in-line skating has become increasingly popular. Aggressive in-line skates include an upper boot and a lower base that is ruggedly constructed. A plurality of wheels are rotatably secured between first and second opposing frame rails to the lower side of the base. The frame rails are either integrally formed with the base, such as by molding, or a frame may be bolted, riveted, or otherwise secured to the base. The base is conventionally molded or assembled from rigid thermoplastic polymers.

The base of an in-line skate defines flat longitudinal surfaces on either side of the frame rails. During aggressive skating maneuvers, a skater may position the base of the in-line skates to contact and slide along stair railings, curbs, ramps, benches or other longitudinal surfaces. This sliding maneuver is referred to as "grinding". The wheels of the in-line skate do not roll along the surfaces as in conventional skating, but rather the flat longitudinal surfaces on either side of the frame directly contact and ride along the wheel, curb, ramp, etc. The skater's weight is directly transmitted through the base to the longitudinal surface on which the skater is grinding, and the skater must carefully control the position of the skate relative to the longitudinal surface to maintain balance.

As the skater slides along the longitudinal surface, significant frictional forces develop between the base of the skate and the longitudinal surface. Over time, this results in substantial wear of the base, scoring deep grooves in the base that ultimately destroy the integrity of the skate. The high strength, rigid plastic materials usually used in the base are not very resistant to wear. The useful life of aggressive skates is significantly limited by this wear and abrasion. Additionally, the skate base should preferably be free to slide smoothly on a longitudinal surface, so as to avoid binding and loss of balance. A worn skate base may bind or seize when a skater attempts to slide or "grind" along a surface, due to the development of excess friction.

SUMMARY OF THE INVENTION

The present invention provides an in-line skate having a frame for mounting a plurality of wheels. The skate includes an upper shoe that receives a person's foot and a base. The base is securable to the upper shoe to support the received foot. A lower surface of the base is securable to the frame. At least portions of the lower surface of the base are formed from a first material. The skate includes at least one wear pad that is securable to the lower surface of the base laterally or medially adjacent to the frame, to extend downwardly from the lower surface of the frame. The wear pad is formed from a second material having a higher degree of wear resistance than the first material.

In a further embodiment of the present invention, the skate includes an upper shoe and a base having an upper surface securable to the upper shoe. A lower surface of the base is securable to the frame. The lower surface defines a grind surface portion adjacent the frame. The skate includes at least one wear pad that is replaceably secured to the grind surface portion of the lower surface of the base, extending below the lower surface of the base.

In a still further aspect of the present invention, replaceable securing of the at least one wear pad is provided by constructing an in-line skate from an upper shoe, an upper base having an upper surface securable to the upper and a lower surface, and a lower base having an upper surface that is detachably securable to the lower surface of the upper base. A lower surface of the lower base is securable to the frame. The lower base defines at least one grind aperture laterally or medially adjacent to the frame. At least one wear pad is received between the lower surface of the upper base and the upper surface of the lower base. The received wear pad is configured to be securely retained between the upper base and the lower base. A wear portion of the wear pad projects downwardly through the grind aperture to extend below the lower surface of the lower base.

The construction of an in-line skate having one or more wear pads in accordance with the present invention provides a wear resistant lower surface of the base. The wear pads makes contact with the railing, curb, ramp or other longitudinal surface during "grinding." The wear pad thus absorbs the wear during grinding, rather than the base itself. Because of the construction of the wear pad from a wear resistant material, and preferably a low-friction material, the life of the skate base is extended, and smooth sliding is provided. In a preferred embodiment of the invention, the wear pads are replaceable, such that the life of the base can be still further extended by replacing worn wear pads with new wear pads, thus further preventing damage or wear to the base itself. A rigid, high strength material can still be utilized for construction of the base, as is desirable, while a less rigid but more wear resistant and lower friction material can be utilized for the wear pads.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
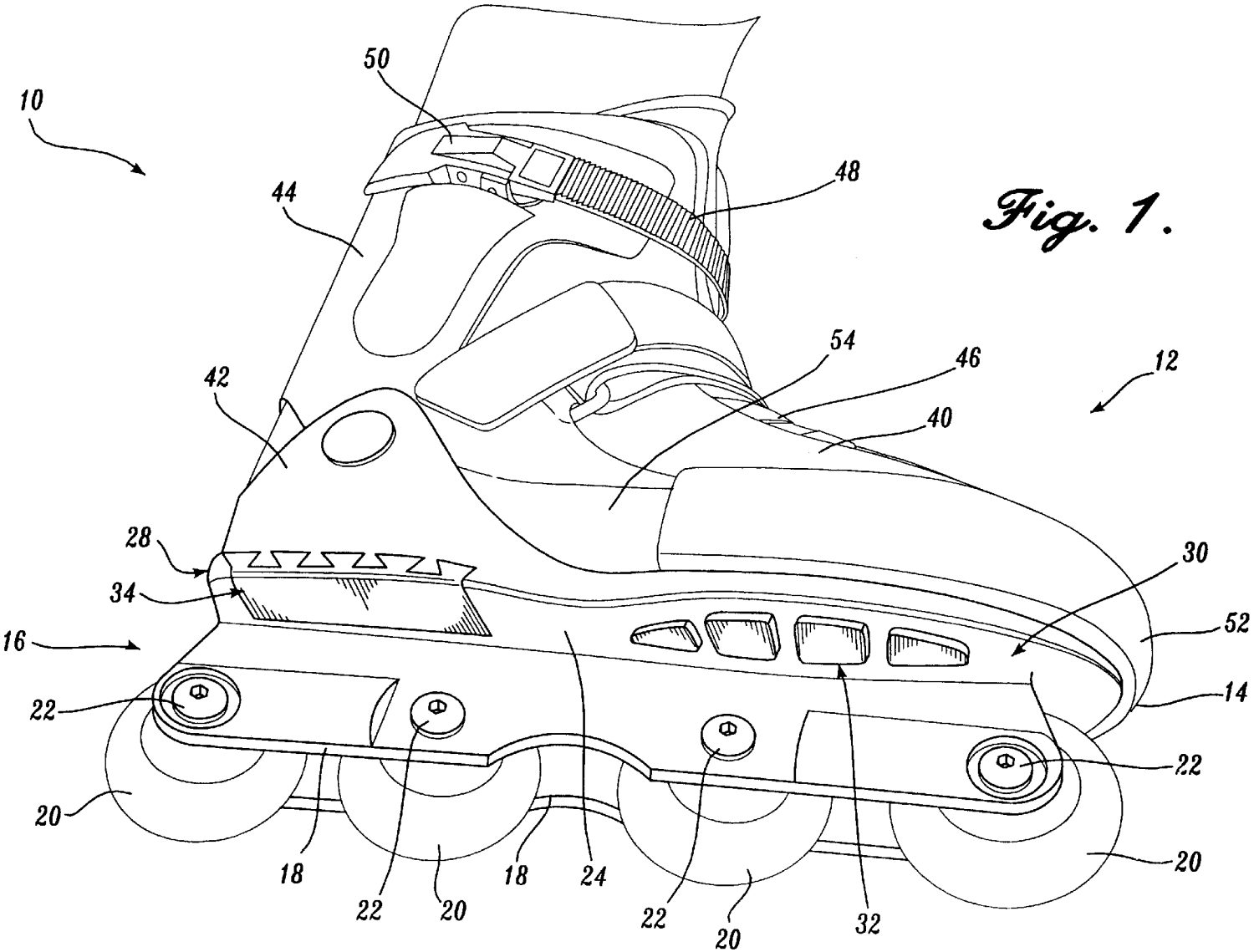
FIG. 1 provides a pictorial view of the base of an in-line skate constructed in accordance with the present invention.

A preferred embodiment of an in-line skate 10 constructed in accordance with the present invention is shown in FIG. 1. The skate 10 has an upper shoe 12 shaped to receive and surround the user's foot, a sole region of which is secured to a base 14. A frame 16 having first and second opposing frame rails 18 is secured to the exterior of the base 14 along the longitudinal axis of the base 14. A plurality of wheels 20 are journalled on axles 22 between the frame rails 18. The base defines a lateral side 24 and a medial side 26 on the outside and inside, respectively, of the frame 16. The lateral side 24 and the medial side 26 each defines a horizontal, longitudinally oriented grind surface on which a skater slides along a longitudinal rail, ramp, curb or other longitudinal surface during court "grinding". The lateral and medial sides 24, 26 extend from a heel portion 28 of the base 14, supporting the heel of a skater, to a toe portion 30, supporting the ball and toes of the foot of the skater. The skate 10 includes a plurality of wear pads secured to the base 14. In particular, the skate 10 includes a front lateral wear pad 32 secured on the lateral side 24 of the toe portion 30 of the base, and a rear lateral wear pad 34 secured on the lateral side 24 of the heel portion 28. Likewise, a front medial wear pad 36 and rear medial pad 38 (FIG. 2) are secured on the medial side 26 of the heel portion 28 and toe portion 30, respectively, of the base 14. As can be readily perceived from FIGS. 1 and 2, the front lateral wear pad 32 and the front medial wear pad 36 extend over a majority of the forefoot portion of the base under the aforementioned ball and toes of the skater's foot; and, the rear lateral wear pad 34 and the rear medial wear pad 38 extend over a majority of the heel portion of the base. The wear pads 32, 34, 36 and 38 provide wear resistant, low friction surfaces on which the user of the skate may grind during aggressive skating maneuvers.

Still referring to FIG. 1, the overall construction of the skate 10 will now briefly be described. Many conventional skate configurations for the upper shoe 12 may be utilized with the base construction of the present invention, including skates having an upper defined by a rigid outer shell that receives a cushioned liner, or skates such as that illustrated in FIG. 1 which have a non-rigid upper shoe portion 40 reinforced by a rigid or semi-rigid heel cup 42 and pivoting ankle cuff 44. One such non-rigid shoe skate construction is more fully described in U.S. Pat. No. 5,437,466 to Meibock et al., the disclosure of which is hereby incorporated by reference. The non-rigid upper shoe portion 40 is formed from fabric, leather or synthetic leathers, and surrounds and closely receives all sides of the user's foot, including the ankle. A lace or other conventional vamp closure 46 secures the upper shoe portion 40 to the user's foot.

The base 14 receives the sole region of the upper shoe portion 40, cradling and supporting the load of a user's foot. The heel cup 42 is integrally formed with the base 14 in the embodiment of FIG. 1, and surrounds the sides of the user's heel. It should be apparent to one of ordinary skill in the art that the heel cup 42 could instead be a separate component that is adhered or otherwise secured to the base 14. The ankle cuff 44 surrounds the sides of the user's ankles and is pivotally secured at its lower extremities to the upper extremities of the heel cup 42. A compression strap 48 secured with a buckle 50 surrounds the user's lower leg above the ankle. The user is able to flex the ankle forwardly and rearwardly upon pivoting the ankle cuff 44. The ankle cuff 44 restrains the user from flexing the ankle laterally or medially, thereby aiding in maintaining proper vertical support.

A rigid or semi-rigid toe protector 52 wraps the ball and toe portions of the upper shoe portion 40, and is secured along its lower perimeter to the perimeter of the base 14, as shall be described. A rigid or semi-rigid side guard 54 snaps into place filling the space between the forward edge of the heel cup 42 and the rearward edge of the toe protector 52, protecting the lateral side of the skate 10 upper from abrasion and wear. Each of the base 14, heel cup 42, and ankle cuff 44, toe protector 52 and side guard 54 is suitably constructed from a substantially rigid polymer, or alternately a semi-rigid polymer, i.e., a polymer which can be deformed and flexed, resiliently springing back to its original configuration. Preferred materials for the base 14 are substantially rigid polymers for maximum strength. Suitable materials include thermoplastic polymers, such as acrylonitrile butadiene styrene or other high strength thermoplastic materials, or thermosetting materials. It should be readily apparent that either of the heel cup 42 and the toe protector 52 could be integrally formed or assembled to the base 14.

In the preferred embodiment, the frame rails 18, each of which consists of a downwardly projecting longitudinal flange, are integrally formed with the base 14, such as by injection molding using a thermoplastic polymer or composite reinforced thermosetting or thermoplastic polymer. However, it should be readily apparent to those of ordinary skill in the art that the frame 16 could be otherwise formed, such as from a formed sheet of reinforced polymer or from a metal casting or extrusion, that is bolted, riveted or otherwise secured to the base 14. The frame 16 is secured along the longitudinal centerline of the underside of the base 14, and is surrounded on either side by the adjacent longitudinal lateral side 24 and medial side 26 of the base 14.

Figure 2:
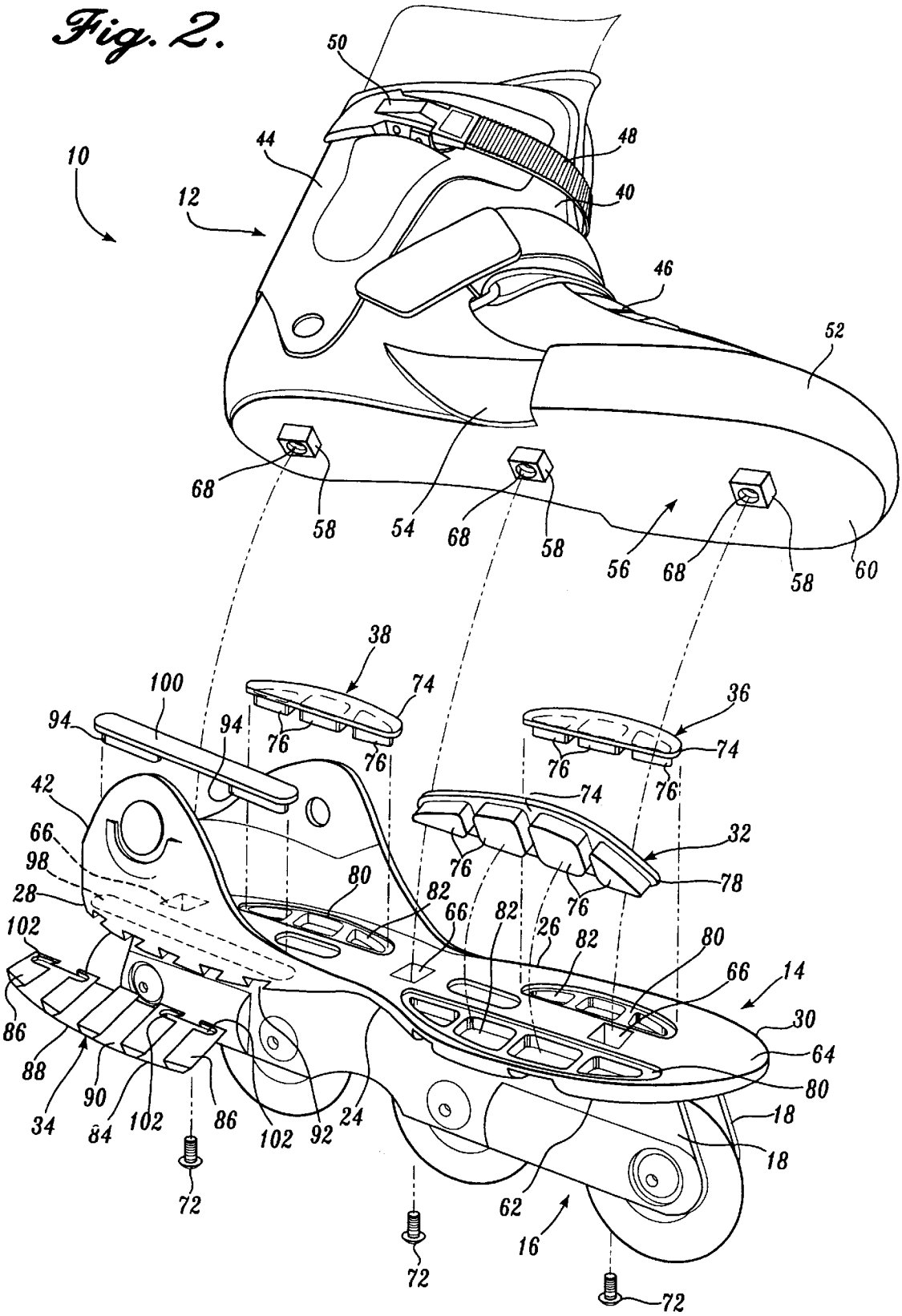
FIG. 2 provides an exploded view of the base and wear pads of the skate of FIG. 1.

Attention is now directed to FIG. 2 to illustrated the mounting of the wear pad 32, 34, 36 and 38. The base 14 is selectively securable to and removable from an upper base 56. The upper surface of the upper base 56 is lasted, i.e., adhered, or otherwise permanently secured such as by sewing or riveting to the bottom of the upper shoe portion 40. The upper base 56 has an overall flat configuration conforming to the outline of the sole of the foot, except that it may preferably be contoured to generally correspond to the curvature of the underside of the foot for greater support. The toe protector 52 may suitably extend upwardly from the perimeter of the upper base 56. Three securement bosses 58 project downwardly along the longitudinal axis of the lower surface 60 of the upper base 56, beneath the toe region, intermediate region and heel region of the upper base 56.

The base 14 defines an exterior, lower surface 62, along which a skater slides during grinding, and a contoured upper surface 64 that receives and mates with the lower surface 60 of the upper base 56. The upper surface 64 thus also generally corresponds to the shape of the sole of the foot, and includes three engagement recesses 66 that are positioned correspondingly and inversely contoured relative to the engagement bosses 58 of the upper base 56. Each of the recesses 66 receives the corresponding boss 58 of the upper base 56 when the upper base 56 is installed on the base 14. An internally threaded insert 68 is molded within each of the bosses 58 of the upper base 56. An aperture (not shown) is formed centrally in each of the recesses 66, and aligns with the internally threaded passage of the inserts 3. Threaded fasteners 72 are inserted from the lower surface 62 of the base 14 and threadedly engaged within the threaded inserts 68 of the upper base 56 to secure the base 14 to the upper base 56. This selectively affixes the upper shoe portion 40 to the base 14 to prevent any vertical or horizontal movement therebetween. The base 14 may also be disassembled from the upper base 56 by removing the fasteners 72, as shall be described subsequently, for purposes of replacing the wear pads 32, 34, 36 and 38.

While the use of threaded inserts 68 within bosses 58 on the upper base 56 and fasteners (72) installed through the base 14 have been illustrated and described, it should be readily apparent to those of ordinary skill in the art that other methods of detachably securing the base 14 to the upper base 56 could be utilized. Thus, for example, externally threaded inserts could be molded into the upper base 56 (not shown) to project downwardly therefrom, receiving threaded nuts from the underside of the base 14. Locking pins could be laterally inserted through interleaved fastening portions (not shown) on the upper base 56 and the base 14, as a further example.

Figure 3:
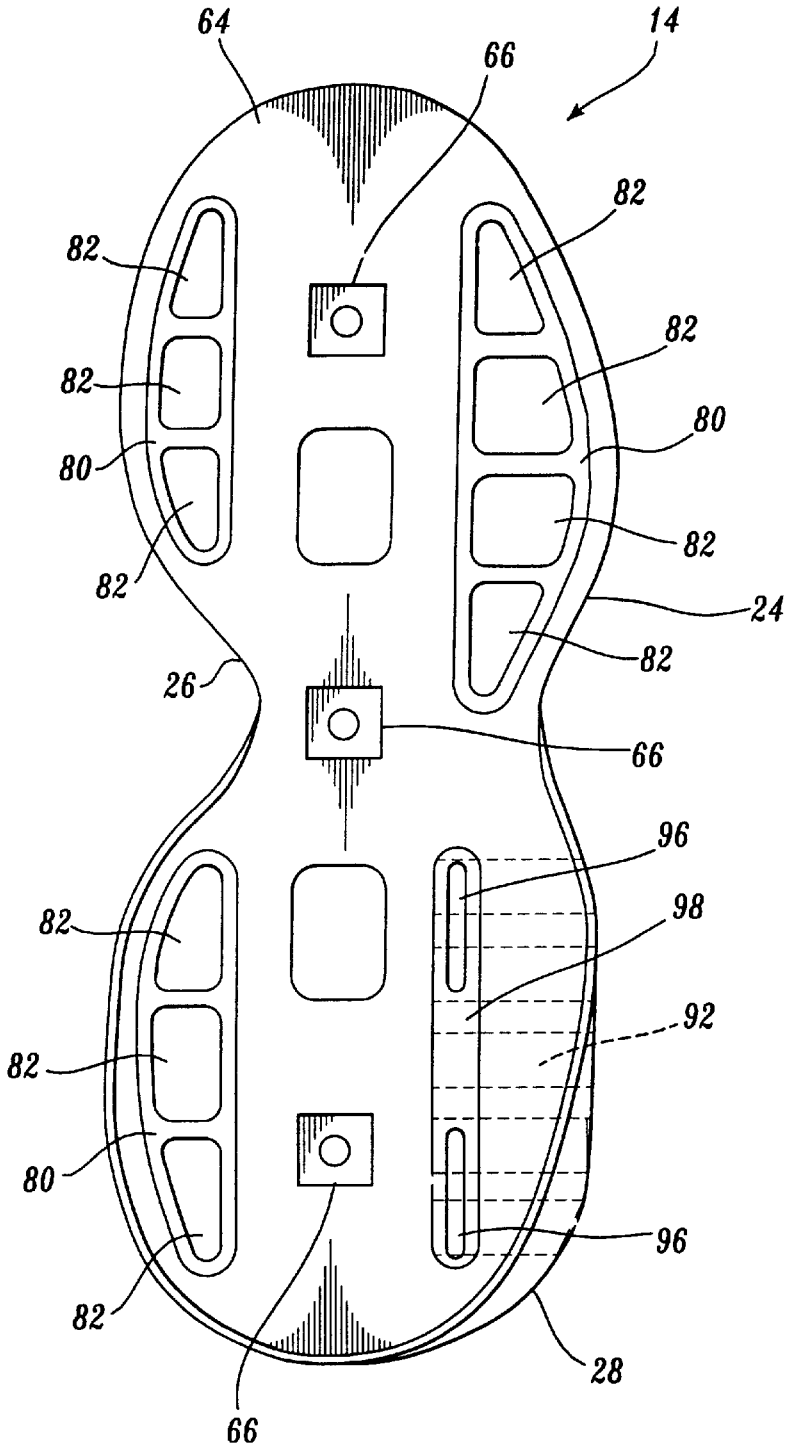
FIG. 3 provides a top plan view of the base of the skate of FIG. 1.

Attention is now directed to FIGS. 2 and 3 to further describe the construction and mounting of the wear pads 32, 34, 36, and 38. Preferably, each of the wear pads is constructed from a wear-resistant material, preferably a wear-resistant polymer that has a low coefficient of friction. The material is suitably semirigid, and has a lower degree of rigidity, lower coefficient of friction, and higher wear-resistance than the material utilized to form the base 14. Suitable materials for use in forming the wear pads include ultra-high molecular weight polyolefins, such as ultra-high molecular weight polyethylene or polypropylene. Other suitable materials may include Nylon™ polyamide. Most preferably, the base 14 will be constructed from a rigid material, while the wear pads are constructed from a semi-rigid material.

In the preferred embodiment illustrated, each of the front lateral wear pad 32 and front and rear medial wear pads 36 and 38 is similarly constructed and mounted. Each of the wear pads 32, 36, and 38 includes an upper sheet portion 74 and three (wear pads 36 and 38) or four (wear pads 34) lower wear portions 76. The upper sheet portion 74 is configured as an elongate flat sheet. The lower wear portions 76 are configured as generally rectangular projections descending downwardly from the upper sheet portion 74 in a longitudinal spaced sequence. The upper sheet portion 74 defines an integral flange 78 that surrounds the lower wear portions 76.

Referring still to FIGS. 2 and 3, it can be seen that the outer perimeter of the upper sheet portions 74, and the shape of the lower wear portions 76, is tailored to generally follow the contours of the toe portion 30 and lateral heel portion 28 of the frame 14. Thus, the horizontal width of the rearward and forward ends of the upper sheet portion 74, and the horizontal width of the rearwardmost and forwardmost lower wear portions 76 of each of the wear pads 32, 36, and 38, tapers in width to correspond with the tapering of the width of the base 14.

Three wear tab recesses 80 are defined in the upper surface 64 of the base 14 for receiving the front lateral wear pad 32 and front and rear medial wear pads 36 and 38. Each of the wear tab recesses 80 is contoured to correspond to the perimeter and depth of the upper sheet portion 74 of the wear pads, and to overlie substantially the majority of the lateral side 24 of the toe portion 30 and the medial side 26 of the toe portion 30 and heel portion 28 of the base 14. Three or four wear tab apertures 82 are formed through the base 14 within each of the recesses 80, and correspond in location and contour to the lower wear portions 76 of each of the wear pads 32, 36, and 38. The wear pads 32, 36, and 38 can thus be assembled into the base 14, when the base 14 is detached from the upper base 56, by placing the wear pads 32, 36 and 38 downwardly into the recesses 80. The lower wear portions 76 of each of the wear pads 32, 36 and 38 are closely and slidably received within the wear tab apertures 82, and the upper sheet portion 74 of each of the wear tabs is closely and slidably received within the recesses 80. It should be apparent that the exact shape or number of wear tabs may be varied within the scope of the present invention.

The upper surfaces of the upper sheet portions 74 of each of the wear pads 32, 36 and 38 are gradually contoured to follow the contours of the upper surface 64 of the base 14, thereby providing a uniform, smoothly contoured surface for supporting the skater's foot. Securing the base 14 to the upper base 56 sandwiches the flange 78 of each of the wear pads 32, 36 and 38 between the base 14 and the upper base 56, thereby securely retaining the wear pads therebetween.

Referring back to FIG. 1, and to FIG. 3, the lower wear portions 76 project downwardly through the wear tab apertures 82 of the base 14, and are separated by transverse portions of the base 14 defined within the recesses 80 between the wear tab apertures 82. The height of the lower wear portions 76 of the wear pads 32, 36 and 38 is predetermined so that the lower wear portions 76 extend downwardly below the elevation of the lower surface 62 of the base 14. The wear pad 34 is similarly dimensioned, as shall be described subsequently. When a skater grinds along the lateral or medial sides of the base 14, it is thus the lower wear portions 76 of the wear pads (i.e., wear blocks) 32, 34, 36 and 38, which contact the longitudinal surface along which the skater is sliding, isolating and protecting the base 14 itself from wear and damage. Gradually over time, the lower wear portions 76 of the wear pads 32, 34, 36 and 38 will wear away to be even with lower surface 62 of the base 14. Thereupon, in order to prevent damage to the base 14, the skater may remove the base 14 from the upper base 56 by undoing the securing fasteners, and replace the worn wear pads 32, 34, 36 and 38 with new replacement wear pads, thereby extending the life of the skate.

As described above, the front lateral wear pad 32 and medial front and rear wear pads 36 and 38 are mounted between the base 14 and the upper base 56. The rear lateral wear pad 34, contrastingly, is mounted to the exterior of the base 14. However, it should be readily apparent to those of skill in the art that the rear lateral wear pad 34 could instead be configured and mounted in the same fashion as the wear pads 32, 36 and 38.

Attention is now directed to FIGS. 1 and 2 to further describe the mounting and construction of the rear lateral wear pad 34. The rear lateral wear pad 34 is mounted directly on the exterior lower surface 62 of the base 14. The rear lateral wear pad 34 has a generally rectangular configuration, covering substantially the entire length and width of the lateral side 24 of the heel portion 28 of the base 14. The installed rear lateral wear pad 34 thus extends horizontally from the frame 16 to the lateral perimeter edge of the base 14.

The rear lateral wear pad 34 has a sheetlike base portion 84 and elongate dovetailed tongues or ridge portions 86. The base portion 84 has a flat lower surface that wears during use, and an upper surface 90 on which the ridge portions 86 are formed. Each of the ridge portions 86 extends transversely across the width of the upper surface 90 of the rear lateral wear pad 34. Each of the ridge portions 86 has a dovetailed or inversely beveled profile when viewed endwise.

The lower surface 62 of the base 14 defines a plurality of transverse grooves 92 extending across the width of the lateral side 24 of the heel portion 28 of the base 14. Each of the grooves 92 is undercut on each side, defining a cross-sectional profile that corresponds to the dovetailed ridge portions 86. The rear lateral wear pad 34 is installed by sliding it horizontally and inwardly in the lateral direction, from the outside of the base 14 towards the frame 16, with the ridge portions 86 being received and engaged within the grooves 92 of the base 14. The rear lateral wear pad 34 may be slid laterally inwardly fully until it stops against the inward extremities of the grooves 92 and the frame 16. When so installed, the entire depth of the base portion 84 of the rear lateral wear pad 34 extends below the lower surface 62 of the base 14, such that it absorbs the wear during grinding maneuvers.

The engagement of the ridge portions 86 and grooves 92 prevents the rear lateral wear pad 34 from moving forwardly or rearwardly. In order to lock the rear lateral wear pad 34 into place transversely, first and second locking tabs 94 are provided, as illustrated in FIG. 2. First and second longitudinally spaced elongate slots 96 are formed in the upper surface 64 of the base 14 in the lateral heel portion, immediately adjacent the frame 16. An elongate recess 98 is formed about the slots. The locking tabs 94 are joined by a flange 100. The locking tabs 94 are inserted downwardly into the slots defined in the upper surface 64 of the base 14, with the flange 100 of the locking tabs 94 being received in the recess 98. The lower tips of the thusly installed locking tabs 94 are received with and engage in correspondingly contoured elongate recesses 102 defined longitudinally across the ridged lower surface 88 of the rear lateral wear pad 34. This locking engagement prevents the rear lateral wear pad 34 from being withdrawn from the grooves 92 on the base 14. When the rear lateral wear pad 34 becomes worn, it may be replaced by disassembling the base 14 from the upper base 56, whereupon the locking tabs 94 may be lifted upwardly to permit sliding withdrawal of the rear lateral wear pad 34.

Just as it was noted that the rear lateral wear pad 34 could be alternately configured to correspond to the other wear pads, likewise the other wear pads 32, 36, and 38 could be configured to mount in the same fashion as the rear lateral wear pad 34, utilizing engaging tongue and groove surfaces. Other engaging surfaces for mounting wear pads may also be utilized in accordance with the present invention, such as ridges utilizing a cylindrical profile that engage in corresponding grooves defined in the base, or bulbous locking protuberances defined on the upper surface of the wear pads that snap into apertures defined in the base (not shown).

The wear pads 32, 34, 36 and 38 of the present invention have been disclosed as being replaceably mounted on the base 14. While this is a preferred aspect of the present invention, some of the advantages of the present invention are also obtained by instead permanently assembling the wear pads on the base 14. Thus, wear pads could be mounted within recessed apertures in the upper surface of a base as described above, and then permanently secured in that position by lasting the base to an immediately overlying upper shoe portion, within the scope of the present invention. Likewise, integrally molding the wear pads within the base 14, by inserting the wear pads within a mold cavity used to form the base 14, and then injecting material to surround the upper flanged portions of the wear pads, would also be within the scope of the present invention. In these two alternate embodiments, the life of the base would be extended due to the greater wear resistance of the wear pads relative to the base material itself. However, the life of the skate would not be extended as long as in the preferred replaceable wear pad embodiment of the present invention, and thus it is not as preferred.

While the wear pads 32, 34, 36, and 38 of the present invention have been described as being formed from a semi-rigid, wear-resistant polymer, other materials may also be utilized, such as steel or other metals, which would extend the life of the skate, although it would not provide the degree of control provided by the softer polymers.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An in-line skate having a frame for mounting a plurality of wheels, comprising:

an upper shoe for receiving a person's foot;

a base having an upper surface securable to the upper shoe to support the received foot and a lower surface securable to the frame, at least portions of the lower surface being formed from a first material; and at least one wear pad secured to a lower surface portion of the base between the frame and a lateral or medial edge of the base, the lower surface portion of the base defining a forefoot portion under the ball of the foot and a heel portion under the heel of the foot, the at least one wear pad defining a lowermost surface of said lower portion, extending longitudinally adjacent at least a portion of a substantially vertical wall of the frame over a majority of the heel portion of the base and being formed from a second material having a higher degree of wear resistance than the first material.

2. The in-line skate of claim 1, wherein the wear pad is removably secured to the base.

3. The in-line skate of claim 1, wherein the at least one wear pad includes a wear portion that extends downwardly below the lower surface of the base.

4. The in-line skate of claim 3, wherein the wear pad is received on the upper surface of the base, the base defining a grind aperture, the wear portion extending downwardly through the grind aperture below the lower surface of the base.

5. The in-line skate of claim 4, wherein the base comprises:

an upper base portion having an upper surface securable to the upper shoe and a lower surface;

a lower base portion having an upper surface detachably securable to the lower surface of the upper base and a lower surface securable to the frame, the lower base portion defining the grind aperture, the wear pad being receivable between the lower surface of the upper base and the upper surface of the lower base to be securely retained therebetween.

6. The in-line skate of claim 5, wherein a recess is defined by the base between the lower surface of the upper base portion and the upper surface of the lower base portion, the at least one wear pad including a flange surrounding the wear portion that is received within the recess, with the wear portion projecting downwardly from the recess through the grind aperture.

7. The in-line skate of claim 1, further comprising means for replaceably securing the at least one wear pad to the base.

8. The in-line skate of claim 7, wherein the means for replaceably securing comprises a grind aperture defined in the base, the wear pad being received on the upper surface of the base and including a wear portion projecting downwardly through the grind aperture.

9. The in-line skate of claim 8, wherein the base comprises:

an upper base portion having an upper surface securable to the upper shoe and a lower surface;

a lower base portion having an upper surface detachably securable to the lower surface of the upper base and a lower surface securable to the frame, the lower base portion defining the grind aperture, the wear pad being receivable between the lower surface of the upper base and the upper surface of the lower base to be securely retained therebetween.

10. The in-line skate of claim 7, wherein the means for replaceably securing comprises a first engaging surface defined on the lower surface of the base and a mating second engaging surface defined on an upper surface of the wear pad that is selectively engageable with the first engaging surface to securely and replaceably retain the wear pad on the base.

11. The in-line skate of claim 10, wherein the first and second engaging surfaces define mating dove-tailed grooves and flanges engageable by sliding the wear pad horizontally relative to the base.

12. The in-line skate of claim 10, wherein the first and second engaging surfaces are configured so that the wear pad is moved horizontally relative to the base for engagement and disengagement, further comprising locking means carried on the base and selectively engageable with the wear pad to prevent horizontal movement of the wear pad relative to the base.

13. The in-line skate of claim 12, wherein the base defines an aperture, and the locking means comprise a locking tab received through the aperture to engage a mating locking recess defined in the engaged wear pad.

14. The in-line skate of claim 13, wherein the base comprises:

an upper base portion having an upper surface securable to the upper shoe and a lower surface;

a lower base portion having an upper surface detachably securable to the lower surface of the upper base and a lower surface securable to the frame, the lower base portion defining the grind aperture, the locking tab being receivable between the lower surface of the upper base and the upper surface of the lower base to be securely retained therebetween.

15. The in-line skate of claim 1, further comprising a plurality of wear pads securable to the base laterally or medially adjacent the frame.

16. The in-line skate of claim 15, wherein the base defines lateral and medial surface portions disposed laterally and medially, respectively, adjacent the frame, the plurality of wear pads being able to both the lateral and medial surfaces.

17. The in-line skate of claim 16, wherein the base defines toe and heel portions supporting the ball and heel of the foot, respectively, wherein the plurality of wear pads are securable to both the toe and heel portions of the base.

18. The in-line skate of claim 15, wherein the base defines toe and heel portions supporting the ball and heel of the foot, respectively, wherein the plurality of wear pads are securable to both the toe and heel portions of the base.

19. The in-line skate of claim 1, wherein the secured wear pad extends substantially to an outer edge of the base.

20. The in-line skate of claim 1, wherein the base is formed from a rigid first material and the wear pad is formed from a second semi-rigid material.

21. The in-line skate of claim 20, wherein the wear pad is formed from a second material having a low coefficient of friction relative to the coefficient of friction of the first material.

22. The in-line skate of claim 21, wherein the second material comprises ultrahigh molecular weight polyolefin.

23. The in-line skate of claim 1, wherein the at least one wear pad extends laterally from adjacent the wall of the frame to adjacent the edge of the base.

24. The in-line skate of claim 1, further comprising a second wear pad extending longitudinally adjacent at least a portion of a substantially vertical wall of the forefoot portion of the base and extending laterally to adjacent the edge of the base.

25. An in-line skate having a frame for mounting a plurality of 4 wheels, comprising:

an upper shoe for receiving a person's foot;

a base having an upper surface securable to the upper shoe to support the received foot and a lower surface securable to the frame, the base defining a grind surface portion laterally or medially adjacent the frame having a forefoot portion under the ball of the foot and a heel portion under the heel of the foot; and at least one wear pad replaceably secured to the grind surface portion of the base between the frame and a lateral or medial edge of the base to extend below a majority of the heel portion of the lower surface of the base, the wear pad defining a lowermost surface of the base and extending longitudinally adjacent at least a portion of a substantially vertical wall of the frame.

26. The in-line skate of claim 25, wherein the base defines a grind aperture, the wear pad being received on the upper surface of the base and including a wear portion projecting downwardly through the grind aperture.

27. The in-line skate of claim 26, wherein the base comprises:

an upper base portion having an upper surface securable to the upper shoe and a lower surface;

a lower base portion having an upper surface detachably securable to the lower surface of the upper base and a lower surface securable to the frame, the lower base portion defining the grind aperture, the wear pad being receivable between the lower surface of the upper base and the upper surface of the lower base to be securely retained therebetween.

28. The in-line skate of claim 25, wherein a first engaging surface is defined on the lower surface of the base and a mating second engaging surface is defined on an upper surface of the wear pad that is selectively engageable with the first engaging surface to securely and replaceably retain the wear pad on the base.

29. The in-line skate of claim 28, wherein the first and second engaging surfaces define mating dove-tailed grooves and flanges engageable by sliding the wear pad horizontally relative to the base.

30. The in-line skate of claim 28, wherein the first and second engaging surfaces are configured so that the wear pad is moved horizontally relative to the base for engagement and disengagement, further comprising locking means carried on the base and engageable with the wear pad to prevent horizontal movement of the wear pad relative to the base.

31. The in-line skate of claim 30, wherein the base defines a grind aperture, and the locking means comprise a locking tab received through the grind aperture to engage a mating locking recess defined in the engaged wear pad.

32. The in-line skate of claim 25, wherein the at least one wear pad extends laterally from adjacent the wall of the frame to adjacent the edge of the base.

33. The in-line skate of claim 25, further comprising a second wear pad extending longitudinally adjacent at least a portion of a substantially vertical wall of the forefoot portion of the base and extending laterally to adjacent the edge of the base.

34. An in-line skate, comprising:

an upper shoe for receiving a person's foot;

an upper base having an upper surface securable to the upper shoe and a lower surface;

a frame for mounting a plurality of wheels;

a lower base having an upper surface detachably securable to the lower surface of the upper base and a lower surface securable to the frame, the lower base defining at least one grind aperture laterally or medially adjacent the frame; and at least one wear pad receivable between the lower surface of the upper base and the upper surface of the lower base to extend longitudinally along at least a portion of the frame, the received wear pad being configured to be securely retained between the upper base and the lower base and having a wear portion projecting downwardly through the grind aperture to extend below the lower surface of the lower base.

35. The in-line skate of Claim 34, wherein one of the upper base and the lower base include a plurality of threaded inserts secured thereto, further comprising a plurality of threaded fasteners receivable within apertures defined in the other of the upper base and the lower base and engageable with the threaded inserts to selectively secure the upper base to the lower base.

36. The in-line skate of claim 35, wherein the wear pad further comprises a flange surrounding the wear portion, the flange being captured between the upper base and the lower base to retain the wear pad therebetween.

37. An in-line skate having a frame for mounting a plurality of wheels, comprising:

an upper shoe for receiving a person's foot;

a base having an upper surface securable to the upper shoe to support the received foot and a lower surface securable to the frame, at least portions of the lower surface being formed from a first material; and at least one wear pad secured to and projecting through an aperture defined in a lower surface portion of the base between the frame and a lateral or medial edge of the base of the wear pad, the wear pad extending longitudinally adjacent at least a portion of the frame and being formed from a second material having a higher degree of wear resistance than the first material.

* * * * *

UNITED STATES PATENT AND TRADEMARK OFFICE

CERTIFICATE OF CORRECTION

PATENT NO. : 6,164,669
DATED : December 26, 2000
INVENTOR(S) : J.E. Svensson

It is certified that error appears in the above-identified patent and that said Letters Patent is hereby corrected as shown below:

Column 9,
Line 33, "able" should read -- securable --
Line 62, after "plurality of" delete -- "4" --

Signed and Sealed this

Twentieth Day of November, 2001

*Attest:*

Nicholas P. Godici

NICHOLAS P. GODICI
*Acting Director of the United States Patent and Trademark Office*

*Attesting Officer*